US010160465B2

(12) United States Patent
Babanin et al.

(10) Patent No.: US 10,160,465 B2
(45) Date of Patent: Dec. 25, 2018

(54) BOLSTER FOR A FREIGHT RAILWAY CAR TRUCK

(71) Applicant: RAIL 1520 IP LTD, Limassol (CY)

(72) Inventors: Viktor Sergeevich Babanin, Saint Petersburg (RU); Sergey Sergeevich Gavrilov, Saint Petersburg (RU); Ivan Viktorovich Zabadykin, Saint Petersburg (RU); Timofey Sergeevich Kuklin, Saint Petersburg (RU); Pavel Vladimirovich Pavlov, Saint Petersburg (RU); Denis Vladimirovich Shevchenko, Saint Petersburg (RU)

(73) Assignee: RAIL 1520 IP LTD (CY)

( * ) Notice: Subject to any disclaimer, the term of this patent is extended or adjusted under 35 U.S.C. 154(b) by 327 days.

(21) Appl. No.: 15/007,554

(22) Filed: Jan. 27, 2016

(65) Prior Publication Data

US 2016/0214626 A1 Jul. 28, 2016

(51) Int. Cl.
*B61F 5/00* (2006.01)
*B61F 5/04* (2006.01)

(52) U.S. Cl.
CPC ..... *B61F 5/04* (2013.01)

(58) Field of Classification Search
CPC ..... B61F 5/00; B61F 5/02; B61F 5/04
See application file for complete search history.

(56) References Cited

U.S. PATENT DOCUMENTS

| | | | | | |
|---|---|---|---|---|---|
| 2,065,454 | A * | 12/1936 | Hammerstrom | B61F 5/04 | 105/226 |
| 5,111,753 | A * | 5/1992 | Zigler | B61F 5/04 | 105/230 |
| 6,089,166 | A * | 7/2000 | Callahan | B61F 5/52 | 105/226 |
| 6,196,134 | B1 * | 3/2001 | Stecker | B61F 5/04 | 105/199.1 |
| 7,681,506 | B2 * | 3/2010 | Forbes | B61F 5/52 | 105/226 |
| 9,346,098 | B2 * | 5/2016 | Gotlund | B22C 9/02 | |
| 9,789,886 | B2 * | 10/2017 | Forbes | B61F 5/06 | |
| 2002/0152923 | A1 * | 10/2002 | Weber | B61F 5/04 | 105/167 |
| 2016/0214626 | A1 * | 7/2016 | Babanin | B61F 5/04 | |

* cited by examiner

*Primary Examiner* — Jason C Smith
(74) *Attorney, Agent, or Firm* — Hayes Soloway PC

(57) ABSTRACT

A bolster for a freight railway car truck relates to structural elements of freight railway car trucks. Locator recesses (8.2) with bearing surfaces (8.3) and thrust flanges (8.4) are formed in the side walls of guiding pockets (8). Wear-resistant lateral guiding plates (9) are secured within locator recesses (8.2) on the bearing surfaces (8.3), and wear-resistant inserts (10) are secured on inclined bearing seats (8.5). The use of wear-resistant lateral guiding plates (9) and wear-resistant inserts (10) protects side bearing surfaces and inclined bearing seats of guiding pockets (8) engaging with friction wedges of the shock absorber from contact wear.

21 Claims, 3 Drawing Sheets

BOLSTER FOR A FREIGHT RAILWAY CAR TRUCK

This application claims priority to Russian Application No. 2015102487 filed 27 Jan. 2015, herein incorporated by reference in its entirety.

The present invention relates to structural elements of railway rolling stock carriages, in particular to bolsters for freight railway car trucks.

RU 104523 (published on 20 May 2011, Int. class. B61 F 5/52) discloses a bolster for a freight railway car truck, the bolster comprising an upper flange with support shelves for side bearers with two pairs of mounting holes, a center plate with an inner surface and a thrust rim, and guiding pockets arranged at end portions of the bolster and comprising side walls and an inclined bearing seats.

The known bolster however exhibits undesirably low wear resistance of working surfaces of the guiding pockets due to the absence of protective wear-resistant elements. As a result, inclined working surfaces and side working surfaces of the guiding pockets directly engage with friction wedges of the shock absorber, thus leading to undesirable wear and short exploitation period.

Further, RU 118275 (published on 20 Jul. 2012, Int. class. B 61 F5/52) discloses a bolster for a freight railway car truck, the bolster comprising an upper flange with support shelves for side bearers with two pairs of mounting holes, a center plate with an inner surface and a thrust rim, and guiding pockets arranged at end portions of the bolster and comprising side walls and an inclined bearing seats.

Similarly, the disadvantage of said device, which can be considered to be the closest prior art to the present inventive device, is undesirable wear of working surfaces of the guiding pockets engaging with friction wedges of the shock absorber due to lack of wear-resistant elements on planes of the guiding pockets.

The present invention is directed to increasing bolster reliability.

According to one embodiment, the bolster for a freight railway car truck comprises an upper flange with support shelves for side bearers, wherein the side bearers have two pairs of mounting holes: a center plate with an inner surface and a thrust rim, and guiding pockets arranged at end portions of the bolster and comprising side walls and inclined bearing seats; wherein locator recesses with a bearing surface and thrust flanges are formed in the side walls of the guiding pockets, and wherein wear-resistant lateral guiding plates are secured within the locator recesses on bearing surfaces; said guiding plates having thickness greater than the depth of the locator recesses and the height of the thrust flanges, and wherein wear-resistant inserts are secured on the inclined bearing seats of the guiding pockets.

According to another exemplary embodiment, wear-resistant inserts can be secured within the guiding pockets by means of fasteners placed within corresponding through holes formed in the wall of the inclined bearing seats of the guiding pockets and in the wear-resistant inserts.

According to another exemplary embodiment, wear-resistant lateral guiding plates can be secured within the guiding pockets by means of fasteners placed within corresponding through holes formed in side walls of the guiding pockets and in the wear-resistant lateral guiding plates.

According to another exemplary embodiment, fasteners can be selected from screws, bolts and nuts, or rivets. Advantageously, the distance between fastener heads and the working surface of the wear-resistant lateral guiding plates and the wear-resistant inserts indicates wear of the working surfaces of the wear-resistant lateral guiding plates and the wear-resistant insert.

According to another exemplary embodiment, the inner side of the side walls of the guiding pockets at exit points of through holes for fasteners is thickened and load-bearing.

According to various exemplary embodiments, wear-resistant lateral guiding plates can be secured within the guiding pockets by welding; wear-resistant inserts can be secured within the guiding pockets by welding; wear-resistant lateral guiding plates or wear-resistant inserts can be secured within the guiding pockets by welding and by means of fasteners; wear-resistant lateral guiding plates and wear-resistant inserts can be secured within the guiding pockets by welding and by means of fasteners.

According to another exemplary embodiment, wear-resistant lateral guiding plates can be made of a composite non-metallic material, e.g. a high molecular weight polyethylene; wear-resistant inserts are made of a composite non-metallic material, e.g. a high molecular weight polyethylene; thrust flanges of the locator recesses of the guiding pockets can be continuous or discontinuous; the end face of the support shelves for side bearers is usually arranged parallel to the end surfaces of the bolster; thickness of the support shelves for side bearers is in the range from 25 mm to 30 mm; area of the support shelves for side bearers can be up to 60% of the bolster upper flange area; the transitional portion between the center plate and the support shelves for side bearers is inclined towards the support shelves for side bearers, wherein the distance between the inner surface of the center plate and the surface of each of the support shelf for side bearers is in the range from 45 mm to 50 mm; and the surfaces of the support shelves for side bearers are raised with respect to the surface of the bolster upper flange for 0 to 10 mm.

Comparative analysis with respect to the prior art shows that the disclosed bolster for a freight railway car truck differs from the known in the prior art in that locator recesses with a-bearing surfaces and thrust flanges are arranged in the side walls of the guiding pockets, wear-resistant lateral guiding plates having thickness greater than the depth of the locator recesses and the height of the thrust flanges are secured within the locator recesses on the bearing surfaces, wear-resistant inserts are secured on the inclined bearing seats of the guiding pockets; wear-resistant inserts are secured within the guiding pockets by means of fasteners placed within corresponding through holes formed in the walls of the inclined bearing seats of the guiding pockets and in the wear-resistant inserts; wear-resistant lateral guiding plates are secured within the guiding pockets by means of fasteners placed within corresponding through holes formed in the side walls of the guiding pockets and in the wear-resistant lateral guiding plates; fasteners are screws, bolts and nuts, or rivets; the distance between fastener heads and the working surface of the wear-resistant lateral guiding plates and the wear-resistant inserts indicates wear of the working surfaces of the wear-resistant lateral guiding plates and the wear-resistant insert; the inner side of the side walls of the guiding pockets at exit points of through holes for fasteners is thickened and load-bearing; wear-resistant lateral guiding plates are secured within the guiding pockets by welding; wear-resistant inserts are secured within the guiding pockets by welding; wear-resistant lateral guiding plates or wear-resistant inserts are secured within the guiding pockets by welding and by means of fasteners; wear-resistant lateral guiding plates and wear-resistant inserts are secured within the guiding pockets by welding and by means of fasteners; wear-resistant lateral guiding plates are made of a composite non-metallic material, e.g. a high molecular weight polyethylene; wear-resistant inserts are made of a composite non-metallic material, e.g. a high molecular weight polyethylene; thrust flanges of the locator recesses of the guiding pockets are continuous or discontinuous; the end face of the support shelves for side bearers is parallel to the end surfaces of the bolster; thickness of the support shelves for side bearers is in the range from 25 mm to 30 mm; area of the support shelves for side bearers is up to 60% of the bolster upper flange area; the transitional portion between the center plate and the support shelves for side bearers is inclined towards the support shelves for side bearers, wherein the distance between the inner surface of the center plate and the surface of each of the support shelf for side bearers is in the range from 45 mm to 50 mm; and surfaces of the support shelves for side bearers are raised with respect to the surface of the bolster upper flange for 0 to 10 mm. The differences from the prior art described hereinabove show that the present technical solution meets the novelty criterion of patentability.

The present invention is described with reference to accompanying drawings, wherein FIG. 1 is the main view of a bolster;

Figure 1:
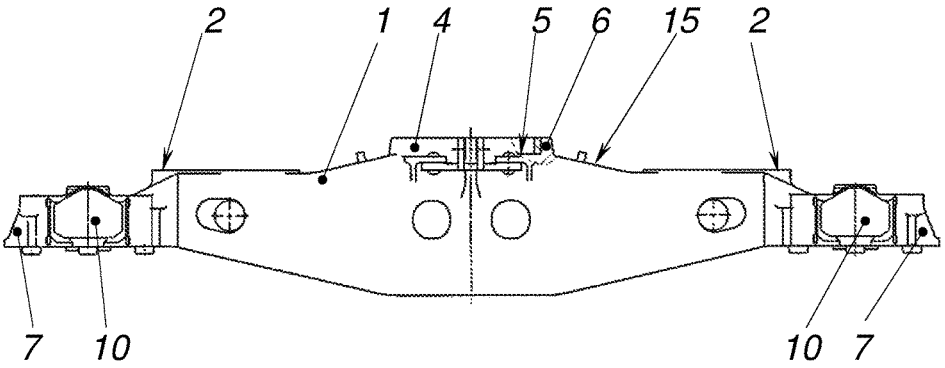
Figure 2:
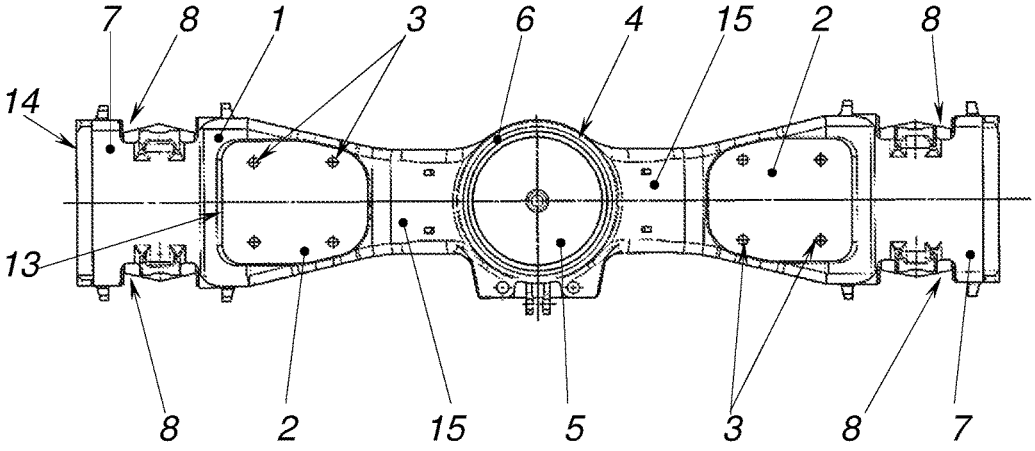
FIG. 2 is a top view of the bolster of FIG. 1.
Figure 3:
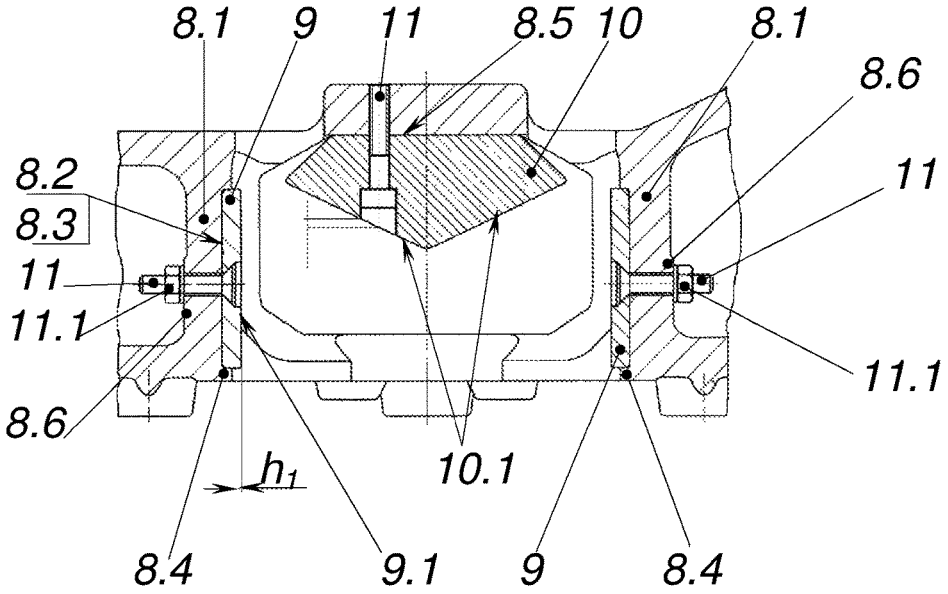
FIG. 3 is a cutaway view of the guiding pocket, in which screws are used as fasteners.
Figure 4:
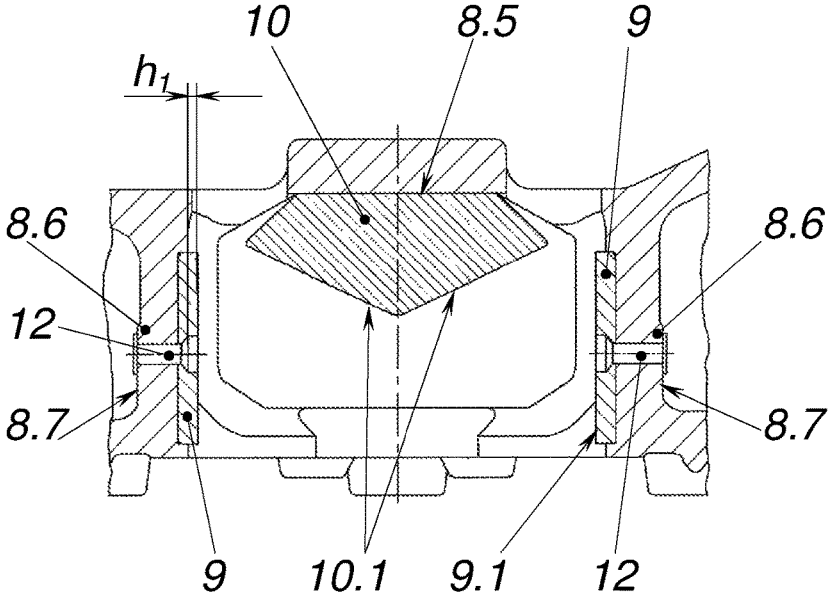
FIG. 4 is a cutaway view of the guiding pocket, in which rivets are used as fasteners.
Figure 5:
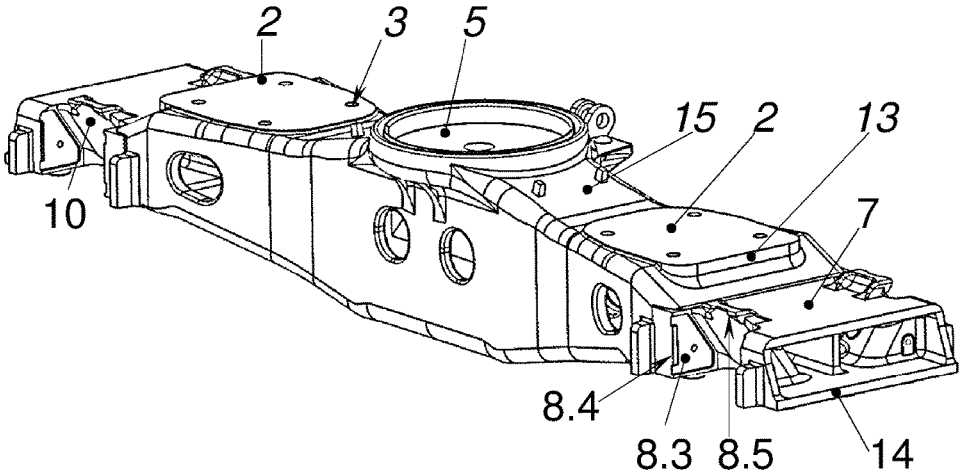
FIG. 5 is an axonometric projection of the bolster.

The bolster for a freight railway car truck comprises an upper flange 1 (FIG. 1, 2) with support shelves 2 and mounting holes 3 for mounting and securing side bearers (not shown), and a center plate 4 with an inner surface 5 intended for receiving vertical load of the rail road car body and a thrust rim 6. Guiding pockets 8 are formed at end portions 7 of the bolster. Protective elements formed by lateral wear-resistant guiding plates 9 and wear-resistant inserts 10 are secured within the guiding pockets 8. Said protective elements are configured for contact engagement with friction wedges (not shown) of a shock absorber of the freight railway car, and are configured to protect surfaces of guiding pockets 8 from wear. Locator recesses 8.2 with a bearing surface 8.3 and thrust flanges 8.4 are formed in side walls 8.1 (FIG. 3, 4) of the guiding pockets 8. Thrust flanges 8.4 function as locator thrusts, orienting and further retaining the wear-resistant lateral guiding plates 9 on the side walls 8.1. Wear-resistant lateral guiding plates 9 are secured within the locator recesses 8.2 on bearing surfaces 8.3 by means of fasteners, e.g. screws 11 or rivets 12. Wear-resistant inserts 10 are secured on the inclined bearing seats 8.5 of the guiding pockets 8 by means of fasteners, e.g. screws 11. In order to ensure protection of side walls 8.1 of the guiding pockets 8, the wear-resistant lateral guiding plates 9 have a thickness greater than the depth of the locator recesses 8.2 and the height of thrust flanges 8.4 (FIG. 4, Side walls 8.1 are provided with thickened portions 8.6 and support shelves 8.7 at exit points of through holes for fasteners 11, 12. Wear-resistant lateral guiding plates 9 and wear-resistant inserts 10 can also be secured within the guiding pockets 8 by welding, wherein welding can be the primary and only fastening means, or additional means when fasteners 11, 12 are used. Welding can be performed using continuous or intermittent welding seams. In case where fasteners formed by screws or rivets 12 are used for securing wear-resistant inserts 10 and wear-resistant lateral guiding plates 9, the distance «$h_1$» (FIG. 4) between fastener 11, 12 heads and working surfaces 9.1, 10.1 can indicate wear of said working surfaces. Wear-resistant lateral guiding plates 9 and wear-resistant inserts 10 can be made of a composite non-metallic material, e.g. a high molecular weight polyethylene. Thrust flames 8.4 of the guiding pockets 8 can be continuous or discontinuous. The end face 13 of the support shelves 2 for side bearers is positioned parallel to end surfaces 14 of the bolster, wherein thickness «$h_2$» (FIG. 1) of the support shelves 2 for side bearers is in the range from 25 mm to 30 mm. The area of the support shelves 2 for side bearers can be up to 60% of the bolster upper flange 1 area. Transitions 15 from the center plate 4 to support shelves 2 for side bearers are inclined towards the corresponding support shelves 2 for side bearers. The distance between the inner surface 5 of the center plate and the surface of each of the support shelf 2 for side bearers is in the range from 45 mm to 50 mm. The surfaces of the support shelves 2 for side bearers can be raised with respect to the surface of the bolster upper flange for 0 to 10 mm.

The bolster for a freight railway car truck is utilized as follows.

Figure 6:
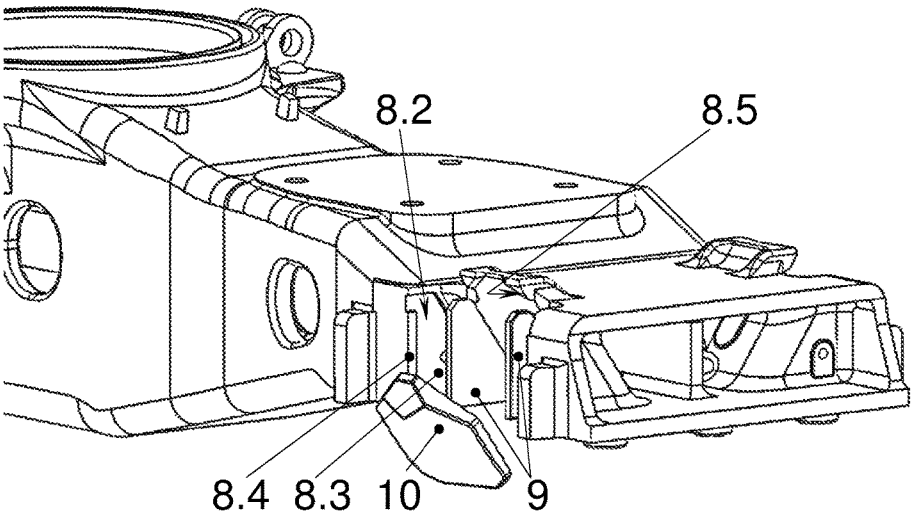
FIG. 6 is a partial exploded view of the axonometric projection of the bolster with wear-resistant elements shown separately for clarity.

Freight railway car wagon-weight load is transferred to the inner surface 5 of the center plate 4 and to the support shelves 2. The load is then transferred from the bolster to friction wedges and springs of the spring set (not shown) via wear-resistant inserts 10 (FIG. 6) mounted on the inclined bearing seats 8.5. Friction wedges received in the guiding pockets 8 between wear-resistant lateral guiding plates 9 engage with working surfaces 10.1 of the wear-resistant inserts 10, thus absorbing bolster vibration with respect to the side frame of the freight railway car truck by means of frictional forces arising between said surfaces. Side walls 8.1 of the guiding pockets 8 are reliably protected from the effects caused by friction wedges due to the fact that wear-resistant lateral guiding plates 9 have a thickness greater than the depth of locator recesses 8.2 and the height of thrust flanges 8.4. Distances «$h_1$» (FIG. 3, 4) between fastener heads and working surfaces 9.1, 10.1 of the protective elements 9, 10 can be used as wear limit indicators for said working surfaces. The wear limit of protective elements 9, 10 is reached when distances «$h_1$» reach zero and end surfaces of fastener 11, 12 heads start experiencing wear, whereupon said protective elements need to be replaced.

The use of protective elements formed by lateral wear-resistant guiding plates 9 on the side walls 8.1 and by wear-resistant inserts 10 on inclined bearing seats 8.5 of the guiding pockets 8, and the use of thrust flanges 8.4 functioning as locator abutments orienting and further retaining wear-resistant guiding plates 9 on the side walls 8.1, result in a significant increase in reliability of the bolster for a freight railway car truck. Combined attachment of the protective elements by means of fasteners and welding, or separate attachment only by means of fasteners or only by welding, further increases bolster reliability.

The invention claimed is:

1. A bolster for a freight railway car truck, the bolster comprising:

an upper flange (1) with support shelves (2) for side bearers, wherein the side bearers have two pairs of mounting holes;

a center plate (5) with an inner surface (5) and a thrust rim (6); and guiding pockets (8) arranged at end portions (7) of the bolster and comprising side walls (8.1) and inclined bearing seats (8.5);

the bolster characterized in that locator recesses (8.2) with a bearing surface (8.3) and thrust flanges (8.4) are formed in the side walls (8.1) of the guiding pockets (8), wherein wear-resistant lateral guiding plates (9) are secured within the locator recesses (8.2) on bearing surfaces (8.3), said guiding plates (9) having thickness greater than the depth of the locator recesses (8.2) and the height of the thrust flanges (8.4);

and wherein wear-resistant inserts (10) are secured on the inclined bearing seats (8.5) of the guiding pockets (8).

2. The bolster according to claim 1, characterized in that wear-resistant inserts (10) are secured within the guiding pockets (8) by means of fasteners (11) placed within corresponding through holes formed in the wall of the inclined bearing seats (8.5) of the guiding pockets (8) and in the wear-resistant inserts (10).

3. The bolster according to claim 2, characterized in that fasteners (11, 12) are screws, bolts and nuts, or rivets.

4. The bolster according to claim 2, characterized in that the distance between fastener heads and the working surface of the wear-resistant lateral guiding plates (9) and the wear-resistant inserts (10) indicates wear of the working surfaces of the wear-resistant lateral guiding plates (9) and the wear-resistant inserts (10).

5. The bolster according to claim 2, characterized in that the inner side of the side walls (8.1) of the guiding pockets (8) at exit points of through holes for fasteners is thickened and load-bearing.

6. The bolster according to claim 1, characterized in that the wear-resistant lateral guiding plates (9) are secured within the guiding pockets (8) by means of fasteners (11, 12) placed within corresponding through holes formed in the side walls (8.1) of the guiding pockets (8) and in the wear-resistant lateral guiding plates (9).

7. The bolster according to claim 6, characterized in that fasteners (11, 12) are screws, bolts and nuts, or rivets.

8. The bolster according to claim 6, characterized in that the distance between fastener heads and the working surface of the wear-resistant lateral guiding plates (9) and the wear-resistant inserts (10) indicates wear of the working surfaces of the wear-resistant lateral guiding plates (9) and the wear-resistant inserts (10).

9. The bolster according to claim 6, characterized in that the inner side of the side walls (8.1) of the guiding pockets (8) at exit points of through holes for fasteners is thickened and load-bearing.

10. The bolster according to claim 1, characterized in that the wear-resistant lateral guiding plates (9) are secured within the guiding pockets (8) by welding.

11. The bolster according to claim 1, characterized in that the wear-resistant inserts (10) are secured within the guiding pockets (8) by welding.

12. The bolster according to claim 1, characterized in that the wear-resistant lateral guiding plates (9) or wear-resistant inserts (10) are secured within the guiding pockets (8) by welding and by means of fasteners (11, 12).

13. The bolster according to claim 1, characterized in that the wear-resistant lateral guiding plates (9) and wear-resistant inserts (10) are secured within the guiding pockets (8) by welding and by means of fasteners (11, 12).

14. The bolster according to claim 1, characterized in that the wear-resistant lateral guiding plates (9) are made of a composite non-metallic material, e.g. a high molecular weight polyethylene.

15. The bolster according to claim 1, characterized in that the wear-resistant inserts (10) are made of a composite non-metallic material, e.g. a high molecular weight polyethylene.

16. The bolster according to claim 1, characterized in that the thrust flanges (8.4) of the locator recesses (8.2) of the guiding pockets (8) are continuous or discontinuous.

17. The bolster according to claim 1, characterized in that the end face (13) of the support shelves (2) for side bearers is parallel to the end surfaces (14) of the bolster.

18. The bolster according to claim 1, characterized in that the thickness of the support shelves (2) for side bearers is in the range from 25 mm to 30 mm.

19. The bolster according to claim 1, characterized in that the area of the support shelves (2) for side bearers is up to 60% of the bolster upper flange (1) area.

20. The bolster according to claim 1, characterized in that the transitional portion between the center plate (4) and the support shelves (2) for side bearers is inclined towards the support shelves (2) for side bearers, wherein the distance between the inner surface (5) of the center plate (4) and the surface of each of the support shelf (2) for side bearers is in the range from 45 mm to 50 mm.

21. The bolster according to claim 1, characterized in that the surfaces of the support shelves (2) for side bearers are raised with respect to the surface of the bolster upper flange (1) for 0 to 10 mm.

* * * * *